United States Patent [19]

Kunkel et al.

[11] 4,256,193

[45] Mar. 17, 1981

[54] ROTARY DRILL BIT WITH ROTARY CUTTER

[75] Inventors: Heinrich Kunkel; Armin Olschewski, both of Schweinfurt; Manfred Brandenstein, Aschfeld; Lothar Walter, Schweinfurt, all of Fed. Rep. of Germany

[73] Assignee: Sandvik Ab, Fack & Aktiebolaget SKF, Goteborg, Sweden

[21] Appl. No.: 42,924

[22] Filed: May 29, 1979

[30] Foreign Application Priority Data

May 31, 1978 [DE] Fed. Rep. of Germany ..... 2823698

[51] Int. Cl.[3] ..... E21B 10/22

[52] U.S. Cl. ..... 175/371; 308/8.2

[58] Field of Search ..... 175/227, 228, 229, 337, 175/370, 371, 372; 308/8.2

[56] References Cited

U.S. PATENT DOCUMENTS

| | | | |
|---|---|---|---|
| 2,020,625 | 11/1935 | Thaheld | 175/370 X |
| 2,060,354 | 11/1936 | Thaheld | 175/370 X |
| 2,075,999 | 4/1937 | Reed | 308/8.2 |
| 2,076,001 | 4/1937 | Reed | 308/8.2 |
| 2,194,675 | 3/1940 | Sanders et al. | 175/370 X |
| 2,470,695 | 5/1949 | Goodwin et al. | 175/370 X |

*Primary Examiner*—James A. Leppink
*Assistant Examiner*—Richard E. Favreau
*Attorney, Agent, or Firm*—Eugene E. Renz, Jr.

[57] ABSTRACT

A rotary drill bit having a drill bit body and at least one trunnion projecting from the drill bit body and a rotary cutter supported on at least one radial roller bearing on the trunnion. The rolling elements of the bearing are guided on at least one axial end facing the drill bit body in an outer bearing race groove incorporated in the bore of the rotary cutter. The inner bearing race groove is formed on the trunnion for the rolling elements of the radial roller bearing. At least one filling opening is provided which extends through the drill bit body and trunnion and is essentially axially oriented having one terminal end adjacent the inner bearing race groove and at least one filler piece for sealing the opening.

7 Claims, 2 Drawing Figures

ROTARY DRILL BIT WITH ROTARY CUTTER

BACKGROUND OF THE INVENTION

The present invention relates to drilling apparatus used in the exploration of underground petroleum reserves and more specifically to a rotary drill bit having a plurality of rotary cutters supported for rotation on the drill bit body by a plurality of rolling elements, the rolling elements being laterally guided at least at their axial ends facing the drill bit body in a radially disposed outer bearing race groove incorporated in the bore of the rotary cutter.

Rotary drill bits having conically shaped rotary cutters are known wherein the rotary cutters are supported on a trunnion formed integrally with the drill bit body and a radial roller bearing. The rollers of this bearing are laterally guided in a bearing race groove in the bore of the rotary cutter and supported in place at their axial ends facing away from the drill bit body by means of a flange bolt secured in the trunnion so that each rotary cutter is mounted in a manner preventing removal from the trunnion. An arrangement of this type is shown in the British Pat. No. 456,570. This known assembly has several disadvantages and drawbacks. For example, the construction requires that the flange bolt be shaped in the form of a race element for the axial bearing of the rotary cutter and be made of an expensive bearing material. In order to mount the flange bolt in a precise manner in the trunnion, the bolt has to be machined with close tolerances. Thus, the method of manufacturing is relatively costly. Additionally, a center bore with a relatively large diameter must be provided in the trunnion to receive the highly stressed flange bolt and accordingly, the trunnion of the drill bit body is somewhat weakened and consequently there is the risk of trunnion failure by breakage especially in heavy duty operations.

In accordance with another known rotary drill bit assembly, the rotary cutters are each supported on a trunnion connected in one piece with the drill bit body in a radial roller bearing with conical roller elements. This arrangement is shown in U.S. Pat. No. 2,076,000. This arrangement has the advantage of providing a trunnion which is relatively rigid and possesses good load bearing characteristics. However, a so-called edge ring is required which is located in the bore of the rotary cutter on the side of the roller elements facing the drill bit body which axially guides the roller elements to support the rotary cutter in place on the trunnion. It has been found that the fabrication of the rotary cutter is rather expensive because of the incorporation of the additional edge ring. Furthermore, in heavy duty operations with high impact stresses, it has been observed that a loosening of the edge ring may result and accordingly, presents the disadvantage that the rotary cutter is not adequately secured against being drawn off the trunnion.

SUMMARY OF THE INVENTION

With the foregoing in mind, it is an object of the present invention to provide an improved rotary drill bit which is characterized by novel features of construction and arrangement including a novel mounting arrangement for the cutting rollers which are held in place securely and in an impact resistant manner preventing withdrawal from the trunnion via the rolling elements of at least one of the roller bearings. This produces a comparatively simplified construction which is easily fabricated.

A rotary drill bit constructed in accordance with the present invention assures that the rolling elements of the radial roller bearings are guided between the edges of the inside bearing race groove, are firmly supported on the trunnion and are laterally held in place. In this manner there is no danger of seizing of the bearing race groove edges. The trunnion has a filling opening for insertion of the rolling elements of the radial roller bearings which is of comparatively small diameter and does not detract appreciably from the strength of the trunnion. The trunnion of each rotary cutter may be constructed in one piece with the drill bit body thus providing a further simplification of the fabrication and assembly of the roller bit since the assembly comprises relatively few parts. These parts are comparatively easy to machine so that the fabrication and assembly of the rotary drill bit is simple and economical.

Still a further object of the present invention is to provide an arrangement wherein the outside bearing race groove in the rotary cutter as well as the inside bearing race groove on the trunnion of the radial roller bearings have a relatively large groove depth providing a good lateral guidance of the rolling elements and strong impact resistant edges of the bearing race grooves. The filling opening for the rolling elements in the trunnion is of optimally small cross section and does not harmfully effect the good strength characteristics of the trunnion.

A still further object of the present invention is to provide an improved rotary drill bit wherein the filling opening disposed in the machined bearing race groove is located in the unstressed zone of the radial roller bearing so that the load bearing ability of the radial roller bearing is not effected by this filling opening. Additionally, the filling opening is adajcent the inside heavy walled portion of a drill bit body so that a relatively strong break-proof connection is guaranteed between the trunnion and drill bit body.

In accordance with another feature of the present invention, the outside peripheral surface of the trunnion is supplemented by the correspondingly shaped end surface of the filler piece in such a manner that harmful holes and discontinuities are not present in this outside surface. The specific construction of the filler piece completely seals to complement the inside bearing race groove at the filling opening location without disturbing the rolling kinematics of the rolling elements.

BRIEF DESCRIPTION OF THE DRAWINGS

These and other objects of the present invention of the various features and details of the operation and construction thereof are hereinafter more fully set forth with reference to the accompanying drawings, wherein.

DESCRIPTION OF PREFERRED EMBODIMENTS

Figure 1:
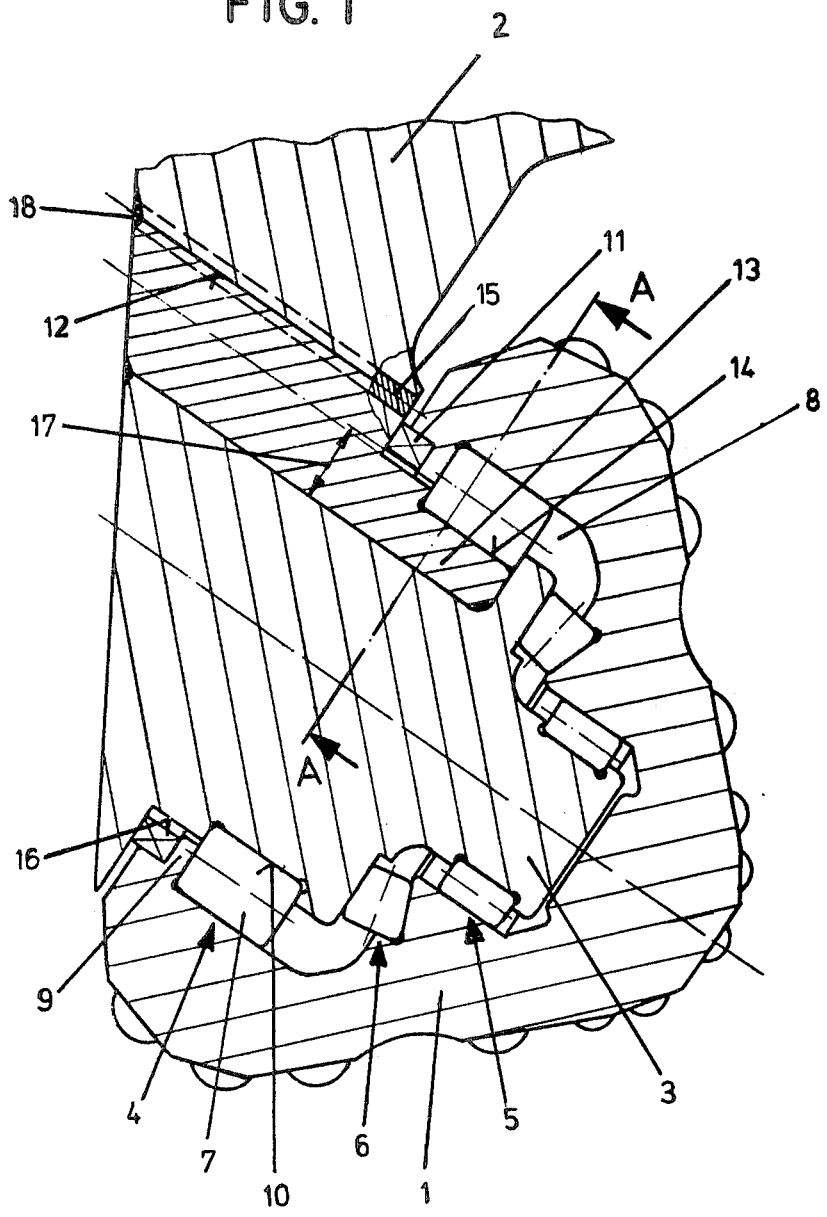
FIG. 1 is a fragmentary longitudinal sectional view through the rotary cutter supported on a trunnion of a rotary drill bit in accordance with the present invention.

Referring now to the drawings and particularly to FIG. 1 thereof, there is illustrated one of a plurality of conical rotary cutters of a rotary drill bit constructed in accordance with the present invention. As illustrated, the rotary cutter which is generally designated by the numeral 1 is rotatably supported on the trunnion 3, which, in the present instance, is formed integrally with the drill bit body 2. The bearing support illustrated includes an outer roller bearing 4 with cylindrical rolling elements 7, an inner radial bearing 5 with cylindrical rolling elements and intermediate axial bearing 6 with conical rolling elements. The rollers 7 of the outer radial roller bearing 4 facing the drill bit body run in the base of the outer bearing race groove 8 formed radially in the rotary cutter 1. The axial end face of the rollers 7 which face the drill bit body 2 are guided by a radially inwardly directed shoulder 9 of the bearing race groove 8 which as illustrated is formed integrally with the rotary cutter 1. The trunnion is formed with a bearing race groove 10 for the rollers 7 of the radial bearing 4 so that rollers 7 are guided and held in place on both sides in the bearing race groove 10. By this construction, the rotary cutter 1 is secured against being drawn off the trunnion 3 by the shoulder 9 and the rollers 7. The inner end of the rotary cutter is provided with a pocket opposite the shoulder 9 to receive an annular seal 11 which as illustrated engages and slides on the opposite confronting front surface of the drill bit body 2 to seal the entire bearing space of the rotary cutter against ingress of foreign matter from the outside of the assembly.

Figure 2:
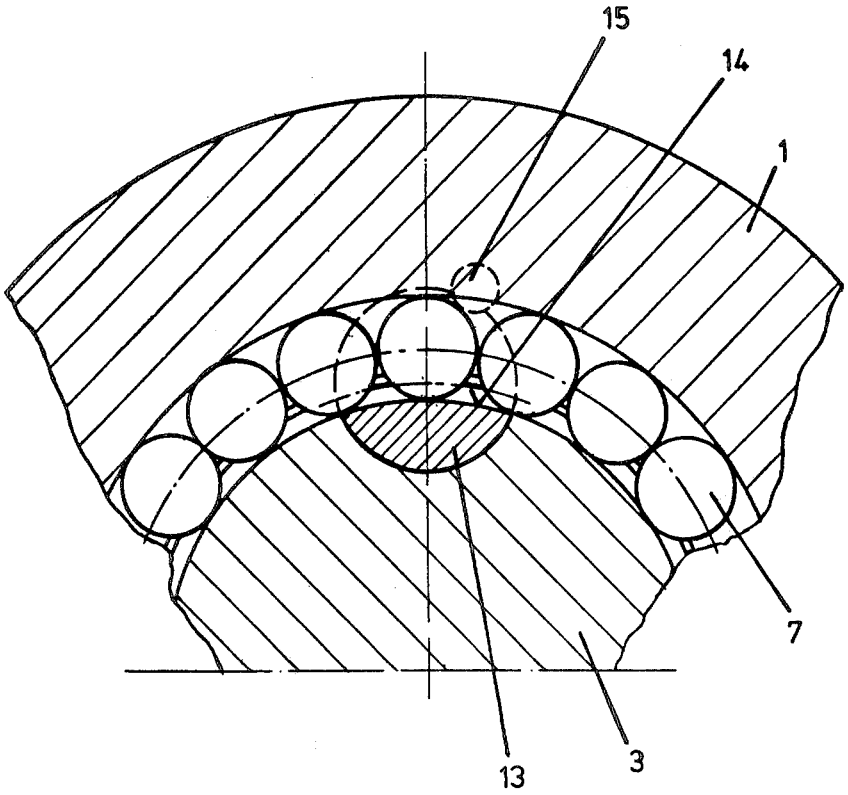
FIG. 2 is an enlarged transverse fragmentary sectional view taken on line on lines A—A of FIG. 1.

Means is provided for filling the outer radial bearing with the rollers via the trunnion. To this end, an axially extending filling opening 12, in the present instance, of circular cross section is bored in the trunnion 3 and extends from the outer end face of the rotary cutter 1 to the bearing groove 10. This filler opening 12 is sealed with a filler piece 13. The filler piece 13 as illustrated in FIGS. 1 and 2 is of a predetermined cross section to fill the opening in the drill bit body and at its inner end is of half moon cross section having a surface 14 which blends smoothly with the bearing race groove 10 to effectively form a smooth continuous bearing race groove surface for the rollers 7. As is clear, discontinuities and holes interrupting the bearing race groove are, therefore, not present.

The filler piece is locked in place in a predetermined position so that the surface 14 confronting the rollers blends smoothly with the bearing race groove 10 and to this end a cylindrical lock pin 15 is provided between the filler piece 13 and the filling opening 12 which as illustrated fits tightly and runs in an axial direction between the filler piece 13 and the opening 12 in a manner preventing twisting or rotation of the filler piece in the filling opening.

The shoulder 9 of the rotary cutter 1 extends radially inwardly closely adjacent the outer peripheral surface 16 of the trunnion adjacent the drill bit body to form a bore on the sides of the rollers 7 facing the drill bit body and form a sealing slot between them. At the same time, the bearing race groove 8 in the rotary cutter 1 as well as the bearing race groove 10 in the trunnion 3 have a fairly large radial depth which is advantageous in that the rollers 7 are laterally guided and securely held in place by the relatively large or high faces of the shoulder 9 and the bearing race groove 10.

In order to accommodate the optimum guide and support for the rollers and also allow for ease of assembly, the radial distance 17 of the filling opening is preferably the same size or slightly larger than the diameter of the cylindrical rollers 7 so that the rollers 7 on assembly through the filling opening 12 can be advanced under the shoulder 9 into the bearing race groove of the trunnion 3. In loading the assembly, the rollers 7 are advanced one after another from there, radially outward into the outside bearing race groove 8 of the rotary cutter 1 and uniformly distributed at the periphery of the rotary cutter 1 simply by rotating it. After a full complement has been inserted into the bearing in the manner described, the filler piece 13 is inserted into the filling opening to seal the same and thereafter the lock pin 15 is pressed into place between the filler piece 13 and the filling opening 12 to prevent twisting of the filler piece as noted above ensure perfect alignment of the surface 14 with the race groove surface 10. To further lock the assembly, the filler 13 may be welded to the drill bit body at the filling end of the opening.

The rotary drill bit according to the invention has a distinct advantage that it is equipped with rotary cutters in a simple economic fabrication, which are held in place securely and impact resistant against being drawn off their trunnion via the roller bodies of at least one radial roller bearing.

Moreover, the rotary drill bit according to the invention is not limited to the above described exemplified embodiments. It can rather be modified within the scope of the basic concept of the invention. The rolling elements of the radial roller bearing may have a convexly shaped or a tapered contour. The rolling elements of the individual roller bearings do not have to be constructed without a cage, in other words, rolls or spheres, they can rather be guided by conventional cages, segments or spacers.

Even though the filler piece of the illustrated embodiment of the invention is held in a fixed correct angular position in the filler opening by means of the lock pin 15, other arrangements are possible to locate the filler so that the surface 14 blends smoothly with the inner raceway surface 10 of the bearing 7. For example, the filler opening and the filler piece may be at least in part of a complementary non-circular cross section, for example, rectangular, thereby to hold the filler piece against rotation in the opening. Alternatively, the filler piece may have radial openings in which set screws or similar securing members engage and which are inserted through the roller bit body. Additionally, note that the inner axial end face of the filler piece remote from the rolling elements is biased or slanted relative to the filler piece axis in order to be flush with the plane of the drill bit body contour and in this position, the surface 14 of the filler piece defining a portion of the raceway 10 for the rolling elements of bearing 7 blend smoothly with the raceway. Accordingly, any angular displacement of the filler piece in the opening from this position would show itself on the surface of the drill bit body, i.e. the axial end face of the filler piece would then at least partly protrude out of the plane of the drill bit body. This would, of course, be visual indicia of incorrect positioning of the filler piece in the opening and would indeed cause difficulty in providing the weldment holding the filler piece in place.

What is claimed is:

1. In a rotary drill bit having a drill bit body and at least one trunnion projecting from the drill bit body and a rotary cutter supported on at least one radial roller bearing on the trunnion, means defining a groove in the trunnion defining an inner raceway for the roller bearing bounded by radially projecting circumferentially extending wall portions which confront opposite axial ends of the rollers, means defining an outer raceway in the interior of the cutter and a continuous circumferentially extending flange extending radially inwardly from one end of the outer raceway, said flange confronting the axial end of the rollers remote from the tip of the rotary cutter, means defining at least one filling opening extending essentially axially through the drill bit body and trunnion having its inner terminal end underlying the inner raceway groove in the trunnion, said filling opening being of a diameter larger than the diameter of the rollers so that the rollers may be freely inserted therein and the distance between the inner edge of the flange and the filling opening being slightly larger than the diameter of the rollers to facilitate passage of the rollers past the flange, and at least one filler piece for sealing the opening.

2. In a rotary drill bit as claimed in claim 1 wherein the filling opening is disposed in the unstressed zone of the radial roller bearing.

3. In a rotary drill bit as claimed in claim 1 wherein the filler piece has a contour in the area of the inner raceway conforming to the outside surface of the trunnion to blend smoothly therewith.

4. In a rotary drill bit as claimed in claim 1 including a locking pin between the filler piece and the filling opening to securely lock the filler piece in place and ensure alignment of said contour surface to said inner raceway groove.

5. In a rotary drill bit as claimed in claim 1 wherein said rollers are cylindrical rollers.

6. In a rotary drill bit as claimed in claim 1 including an annular seal disposed between the drill bit body and said continuous flange to seal the space between the rotary cutter and the trunnion against ingress of foreign matter from outside of the assembly.

7. In a rotary drill bit as claimed in claim 1 wherein the trunnion is formed integraly with the drill bit body.

* * * * *